US005755507A

United States Patent [19]

Hucks

[11] Patent Number: 5,755,507

[45] Date of Patent: May 26, 1998

[54] DEVICE FOR INTERCONNECTING LIGHTING FIXTURES

[75] Inventor: Harold D. Hucks, Atlanta, Ga.

[73] Assignee: GBM Supply, Inc., Atlanta, Ga.

[21] Appl. No.: 548,228

[22] Filed: Oct. 25, 1995

[51] Int. Cl.[6] ..... F21S 3/021

[52] U.S. Cl. ..... 362/219; 362/217; 362/223

[58] Field of Search ..... 362/217, 219, 362/220, 223, 225, 260, 285

[56] References Cited

U.S. PATENT DOCUMENTS 2,298,824 10/1942 Darley ..... 362/219

4,240,130 12/1980 Stilling ..... 362/217

5,060,125 10/1991 Cowie et al. ..... 362/219

*Primary Examiner*—Y My Quach

*Attorney, Agent, or Firm*—Needle & Rosenberg, P.C.

[57] ABSTRACT

An apparatus for providing lighting for store fronts or advertising signs without areas of dimming comprising a channel member, at least one transition section which overlaps the ends of two adjacent elongated tube lights, two end sections, and lamp receptacles disposed in the transition sections and end sections. The transition sections can alternatively interconnect channel light trays to form a continuous channel member.

19 Claims, 5 Drawing Sheets

DEVICE FOR INTERCONNECTING LIGHTING FIXTURES

BACKGROUND OF THE INVENTION

1. Field of the Invention

This invention relates to lighting fixtures and, more particularly, to a device for interconnecting lighting fixtures so as to provide store-front lighting without breaks or areas of dimming.

2. Background Art

The quality of lighting that a merchant or business uses has always had economic importance. A business with a well-lit appearance has commercial appeal. Likewise, nicely illuminated advertising signs have the same effect. The opposite is true if lighting is substandard.

Merchants, therefore, have insisted upon lighting that appears continuous. Lighting, known as "L" shaped notched transition box sections, developed to satisfy this demand. FIGS. 1A and 2A show these prior art lights 10. Each "L" shaped notched transition box section 15 mates with other sections in an overlapping, juxtaposed relationship. As shown best in FIG. 2A, this allows the elongated fluorescent lamps 22 in the "L" shaped transition box sections 15 to overlap. The result is that the light emitted from the series of "L" shaped notched transition box sections 15 appears continuous when used above, and along the length of, a store front or to illuminate an advertising sign.

Each "L" shaped notched transition box section 15 has a light tray 18 and a receptacle mounting top panel 16 at each end. The receptacle mounting panels 16 have a fluorescent lamp receptacle 20, known as a tombstone, mounted therein. A corresponding pair of fluorescent lamp receptacles 20 at opposing ends of the "L" shaped notched transition box section 15 hold an elongated fluorescent lamp tube 22 therebetween and allow that lamp tube 22 to be energized.

The fluorescent lamp receptacles 20 are fixedly attached to the receptacle mounting panel 16 by a receptacle apertures 24 having an alignment flat. An alignment and mounting tongue 26, which has a leaf spring retainer tongue 27, joins the fluorescent lamp receptacle 20 to the receptacle aperture 24. The alignment flat of the receptacle aperture 24 properly mates with the alignment and mounting tongue 26 to ensure proper positioning.

However, a major drawback exists with the present "L" shaped notched transition box sections: the difficulty in electrically wiring the lamp receptacles 20. The "L" shaped notched transition box sections 15 are burdensome, and therefore expensive, to wire. Wiring knock-outs 30, as shown in FIG. 1A, are required on the sides of the receptacle mounting panels 16 where that section 15 contacts the side of an adjacent receptacle mounting panel 16. A wiring ferrule 32 is snapped into the wiring knock-out 30, and the wires run therethrough.

The wires must take a surreptitious path to operate the prior art fixture 10. The wiring traverses a light tray 18 starting from one end of the "L" shaped notched transition box section 15. The wire then electrically connects to a lamp receptacle 20 at the other end of that section 15. From that lamp receptacle 20, the wire must reverse its path and move to the adjacent transition box section 15. To do so, the wire must traverse a wiring knock-out 30 having a wiring ferrule 32 therein. Then, the wire is connected to the other lamp receptacle 20 and the process is repeated to connect the subsequent lamp receptacles 20 using the same tortious path.

It is clear that these prior art lights 10 are difficult for an electrician to wire. This, accordingly, increases the cost of installing the "L" shaped notched transition sections 15 because of its labor-intensive nature. In addition, there is an increased cost for putting the individual transition box sections 15 together, namely, manually aligning the sections 15 and installing the wiring ferrules 32. And, the cost to make a repair or replace a portion of the wiring if a problem occurs is also labor-intensive and, therefore, expensive.

SUMMARY OF THE INVENTION

The above disadvantages in the prior art are overcome by the present invention which provides both an improved lighting apparatus and a device for interconnecting lighting fixtures.

The present invention comprises a channel member having opposed ends separated therebetween by the length of at least two elongated fluorescent tube lights, at least one transition section disposed in the channel, two end sections, and a means for detachably mounting and energizing the elongated tube lights. The end sections are disposed at opposite ends of the channel member. The mounting and energizing means is a lamp receptacle, preferably a tombstone. The present invention can use components already utilized in the art, thus reducing manufacturing costs.

However, unlike the prior art, the channel can be a continuous member by means of transition sections disposed in the channel. Alternatively, transition sections can join together a series of channel members that have a length approximately the same as an elongated tube light.

Without the individual "L" shaped notched transition sections, however, wiring the present invention is much easier than in the prior art. It is thus less expensive to complete. No wiring knockouts are necessary. The wiring, instead, traverses the channel and sequentially connects each lamp receptacle. The wiring does not need to reverse its path or travel through wiring knockouts.

The resultant light emitted from the present invention is continuous as in the prior art. One end of each light tube is detachably mounted to the transition section in an overlapping relationship with one end of another light tube mounted to the same transition section. Because of this overlap, the lighting apparatus emits light that appears continuous without breaks or areas of dimming when used on a store front or within an advertising sign. The similarity in the resultant lighting can be seen by comparing FIGS. 1 and 1A and FIGS. 2 and 2A.

In addition, a transition section can alternatively have more than two lamp receptacles therein, allowing the present invention to hold more fluorescent lights. This increased number of lights can create more intense, fuller lighting. The prior art has no similar feature.

Furthermore, the length of the overlapping relationship of a transition section can be varied so that the overall length of the channel is altered. The transition section, in fact, can also be divided into two separate parts. The advantage of this embodiment is it allows a channel to be different lengths corresponding to the stationary member, such as a store front, upon which the channel is mounted. The prior art has no similar feature.

DETAILED DESCRIPTION OF THE INVENTION

Figures 1, 2:
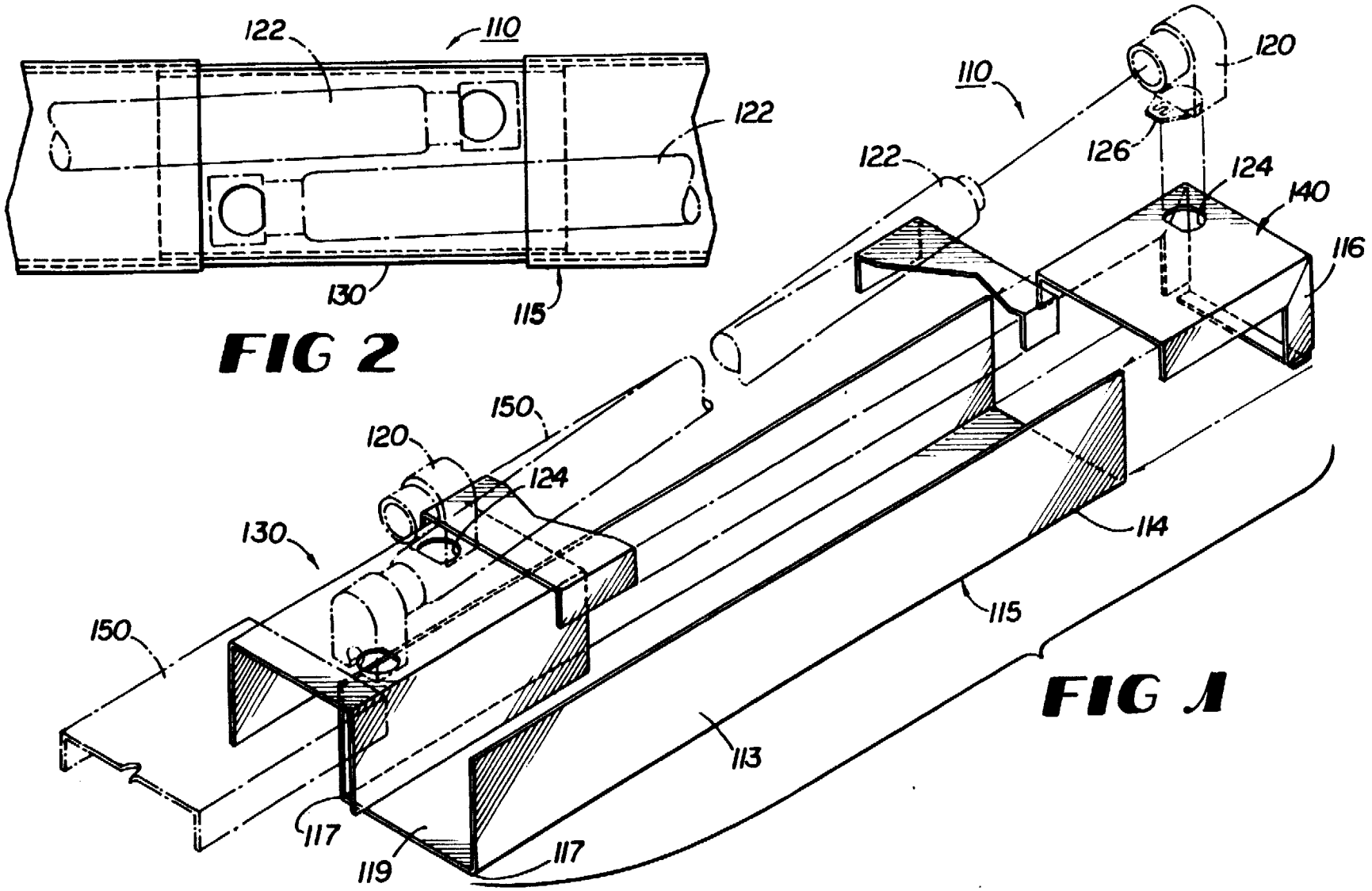
FIG. 1 is an exploded perspective view of the present invention showing both a transition section and an end section.
FIG. 2 is a top plan view of the present invention.
Figure 1A:
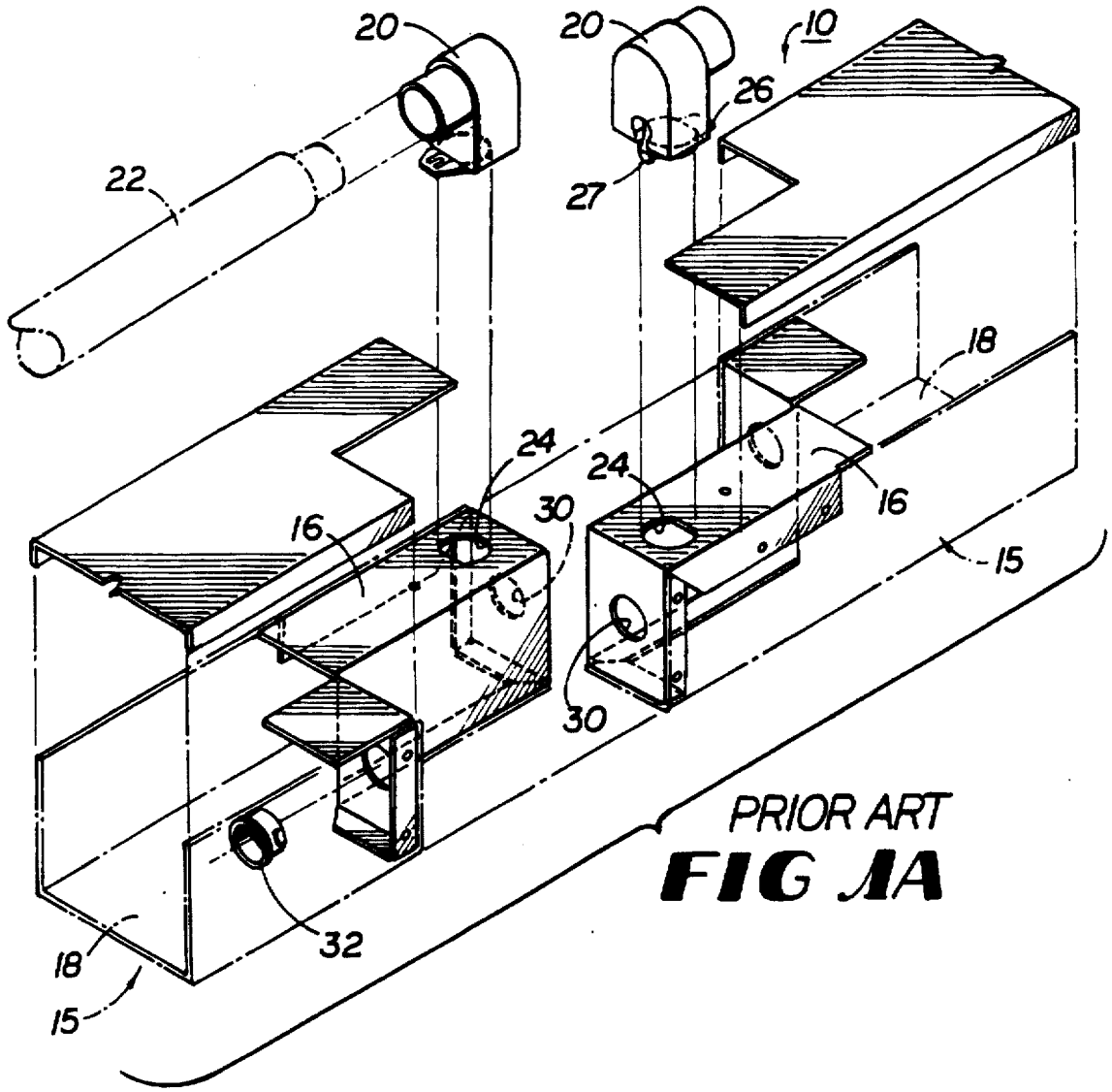
PRIOR ART FIG 1A
FIG. 1A is an exploded perspective view of a prior art lighting device showing adjoining "L" shaped notched transition box sections.
Figure 2A:
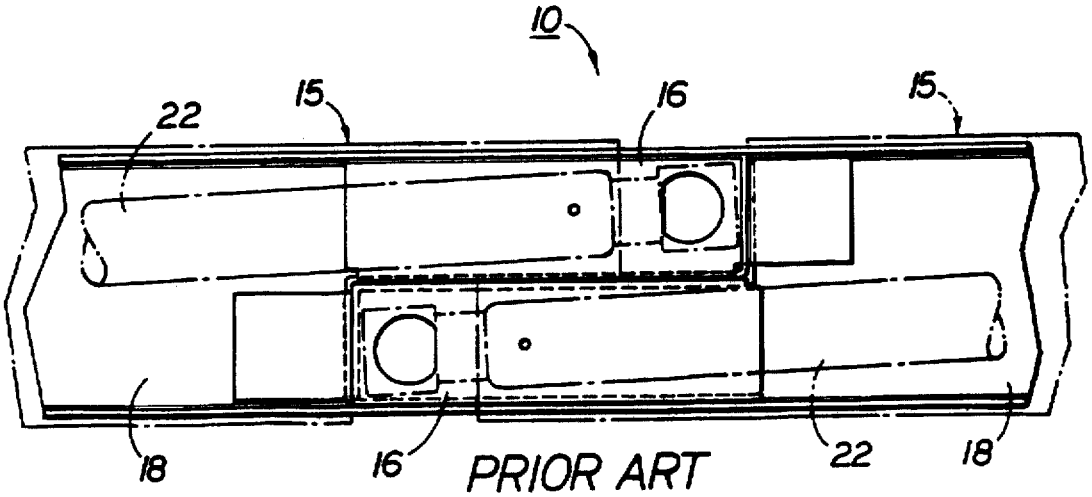
PRIOR ART FIG 2A
FIG. 2A is a top plan view of the prior art lighting device.

The present invention may be understood more readily by reference to the following detailed description of specific embodiments and the Figures included therein.

As used in the specification and in the claims, "a" can mean one or more, depending upon the context in which it is used.

Referring now to the figures of the drawings, the present invention comprises an apparatus 110 for providing lighting which utilizes a plurality of elongated tube lights 122. The apparatus 110 comprises a channel 115 (or channel member) having a front end 116 and an opposite rear end 118 separated therebetween by a length at least as long as two elongated tube lights 122, at least one transition section 130 disposed in the channel 115, two end sections 140, and a means for detachably mounting and energizing the elongated tube lights 122. One end section 140 is disposed at the front end 116 of the channel 115 and the other end section 140 is disposed at the rear end 118 of the channel 115.

The detachably mounting and energizing means is fixedly attached to each transition section 130 and the two end sections 140. One end of each light 122 is detachably mounted to the transition section 130 in an overlapping relationship with one end of another light 122 mounted to the same transition section 130. Because of this overlap, the lighting apparatus 110 emits light that appears continuous without breaks or areas of dimming when used within a store front or advertising sign. The other end of each light 122 is detachably mounted to selected one of another transition section 130 or an end section 140.

The mounting and energizing means preferably is a lamp receptacle 120, such as a tombstone. The lamp receptacles 120 can be mounted using receptacle apertures 124 having an alignment flat in conjunction with an alignment and mounting tongue 126. The present invention thus has the advantage of being made with components already used in the art.

Figure 3:
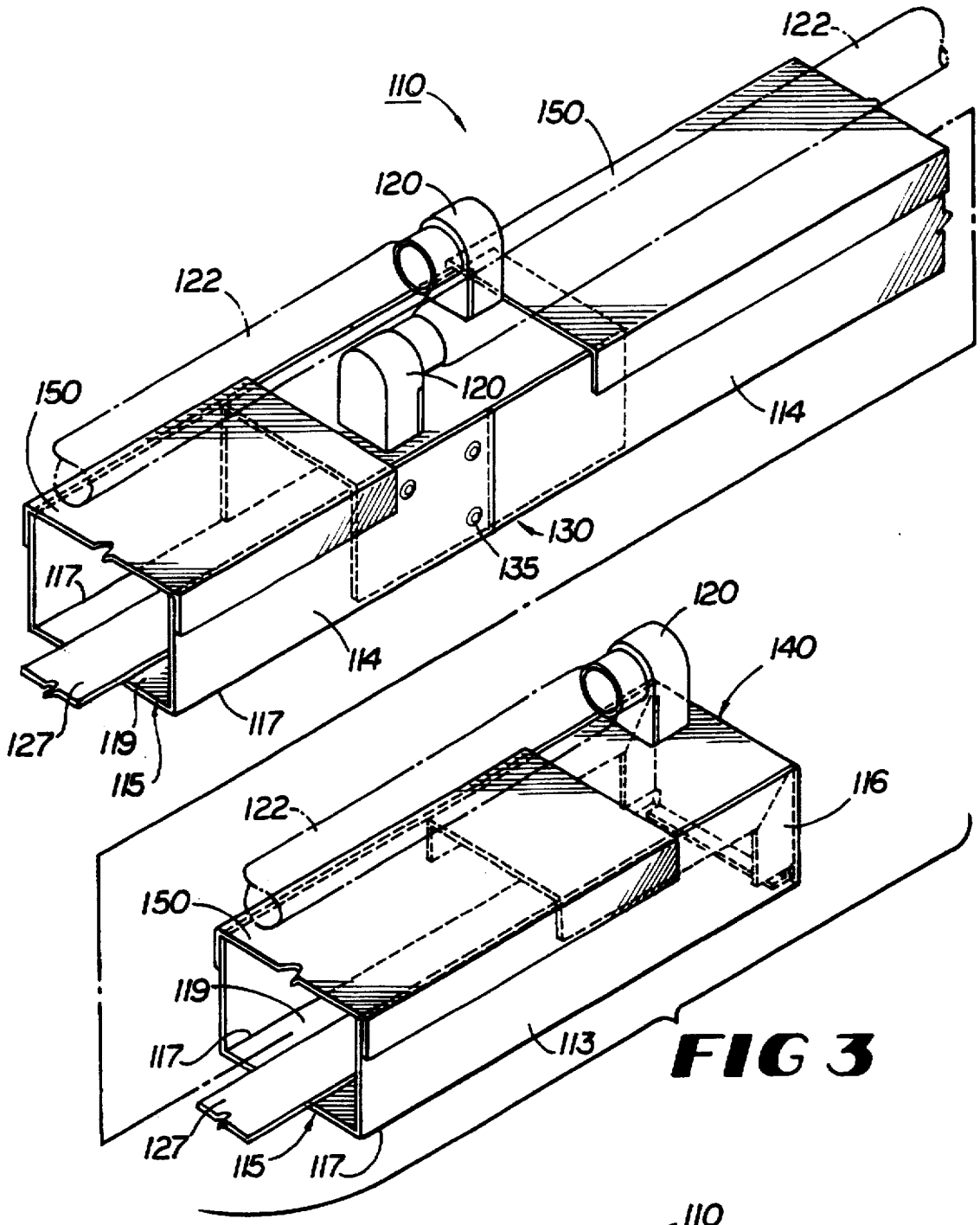
FIG. 3 is a perspective view of the present invention.
Figure 4:
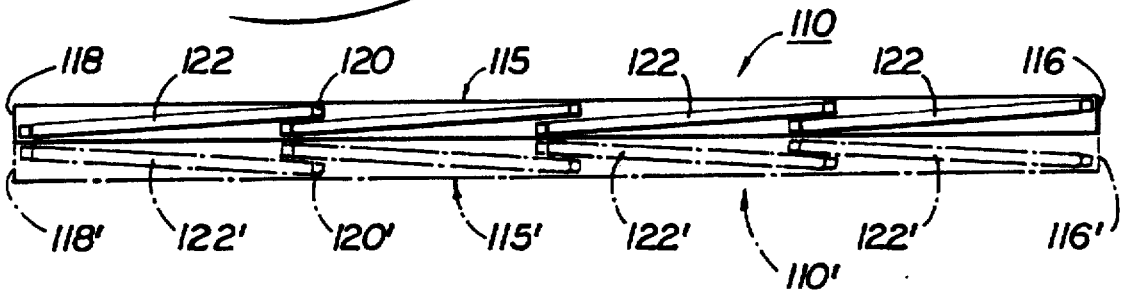
FIG. 4 is a top schematic view showing an overlapping herringbone lamp configuration and, in phantom lines, a symmetric herringbone configuration of the lamps in tandem.
Figure 6A:
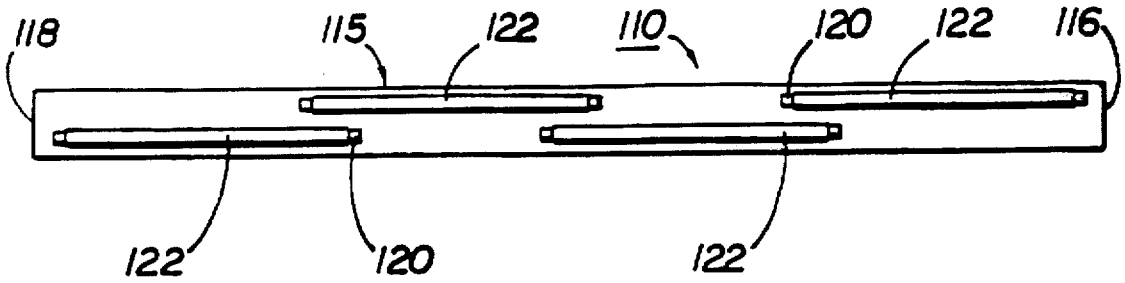
FIG. 6A is a top schematic view showing an overlapping parallel configuration.
Figure 6B:
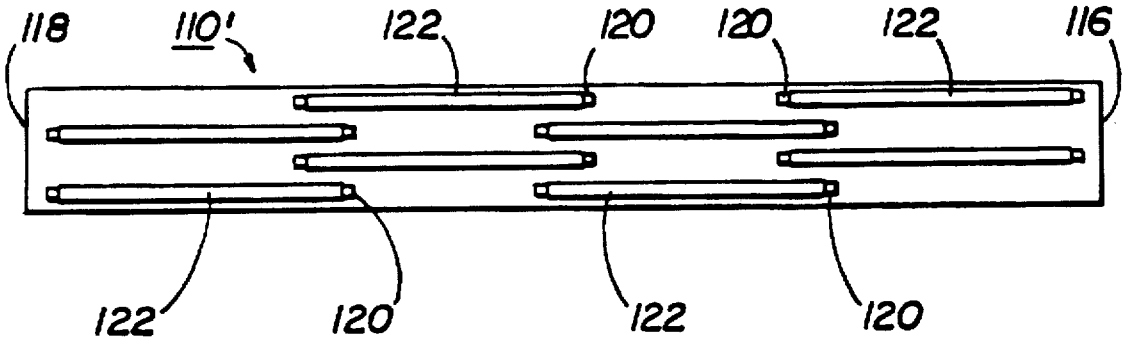
FIG. 6B is a top schematic view showing an overlapping parallel configuration in tandem.

Preferably, each transition section 130 has a pair of lamp receptacles 120, each receptacle 120 facing along the channel 115 in an opposite direction. The pair of lamp receptacles 120 are disposed at opposite corners and on opposite sides of the transition section 130, as shown in FIGS. 1, 2, and 3. A transition section 130 can alternatively have more than two lamp receptacles 120, and thereby hold more fluorescent lights 122. FIG. 4 illustrates each transition section 130 having four lamp receptacles 120, 120'. The same is shown in FIG. 6B. The increased number of lights creates brighter and fuller lighting.

Each end section 140 has at least one lamp receptacle 120. As shown in FIGS. 1 and 3, a corresponding lamp receptacle 120 on an adjacent transition section 130 is disposed toward each lamp receptacle 120 mounted to the end section 140. This allows the tube lights 122 to be detachably mounted therebetween. As with the transition sections 130, the end sections 140 can have as many lamp receptacles 120 as necessary to achieve the desired lighting intensity. FIG. 4 shows an end section having two lamp receptacles 120, 120'. FIG. 6B also shows an end section having two lamp receptacles 120.

Figure 5:
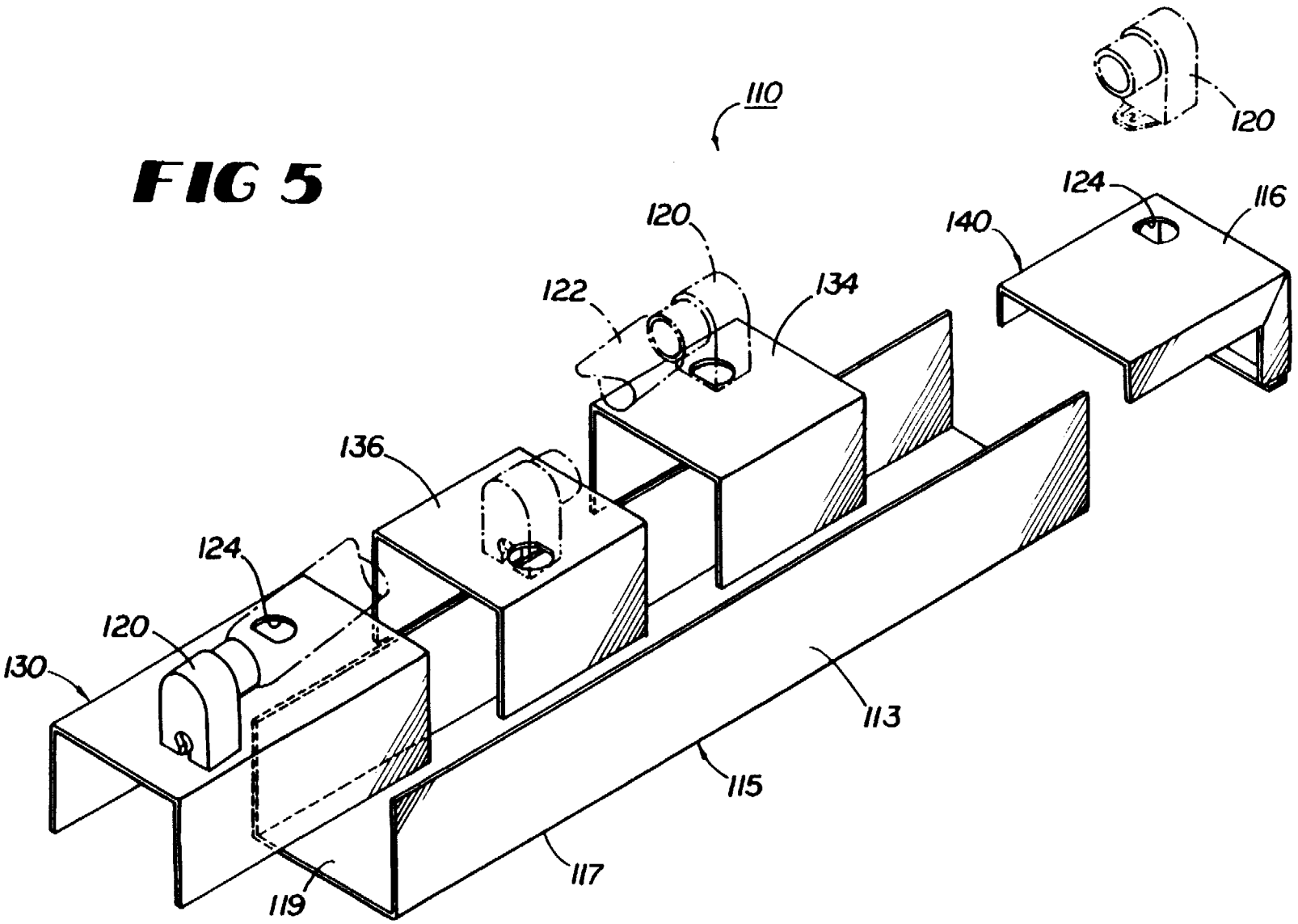
FIG. 5 is a perspective view of the present invention showing an alternative embodiment of a transition section.

The standard length of a tube light 122 is in increment of two feet, e.g., a length of two feet, four feet, six feet, etc. The elongated tube light 122 intermediate one end section 140 and one transition section 130 can be a different length from that of the other tube lights 122 in the channel 115, so that the separation distance between the two end sections 140 is altered. The length of the overlapping relationship in a transition section 130 can also be varied so that the separation distance between the two end sections 140 is altered. As shown in FIG. 5, the transition section 130 can be divided into multiple parts 134, 136. Each transition section part 134, 136 has at least one lamp receptacle 120 therein. The advantage of this alternate embodiment of the transition section 130 is it allows a channel 115 to be different lengths corresponding to the stationary member upon which the channel is mounted, but still use standard length bulbs. This is accomplished by varying the separation intermediate transition section parts 134, 136.

In the preferred embodiment, the channel 115 has a "U" shape in vertical cross-section. The channel 115 has a bottom 119 having two opposed longitudinal edges 117 and two parallel side panels 113 fixedly attached to the longitudinal edges 117 of the bottom 119 and upwardly extending therefrom. The channel 115 can alternatively be a semicircle. As shown in FIGS. 1 and 3, the "U" shaped channel 115 can comprise a plurality of "U" shaped sections, wherein one transition section 130 is telescopically received in both ends of two separate, adjacent "U" shaped sections 114. The transition section 130 is fixedly attached to these two "U" shaped sections 114. The transition section 130 is fixedly attached to the channel 115 by rivets 135, screws, or the like. It is preferred to use three screws through each side panel 113 at the transition section 130 to keep the channels 115 from separating. If the application prohibits the use of side screws during installation, a strip 127 consisting of a metal, such as aluminum, can be used to keep the channels 115 from separating. The preferred dimensions of the strip 127 are 1 inch by 18 inches, and one screw is used on each end of the strip 127. It is also preferred that the length of each "U" shaped section 114 be approximately equivalent to the length of one elongated tube light 122.

Referring now to FIG. 4, the elongated tube lights 122 in the present invention can be arranged in an overlapping herringbone configuration. FIG. 4 also shows a symmetrical herringbone configuration in phantom lines in which all of the additional corresponding components are identified by a reference number having a prime indication. Alternatively, the elongated tube lights can be arranged in an overlapping parallel configuration as shown in FIGS. 6A and 6B.

The lighting apparatus 110 can further comprise a means for fixedly securing the channel 115 to a stationary member. This securing means preferably is achieved by fixedly attaching the channel 115 through its bottom 119 to the place of use, e.g., a store front. Any means to fixedly secure the apparatus 110 known in the art can be used, such as bolts, rivets, and the like.

The lighting apparatus 110 can further comprise a cover plate 150 that is complementary to and designed to be disposed above the channel 115. A closed volume is formed defined by the channel 115 and the cover plate 150.

The present invention also encompasses an apparatus for interconnecting at least two channel light trays (shown, for example, as reference numeral "114," the "U" shaped sections, in FIGS. 1 and 3) in which each channel light trays has two opposing ends being separated therebetween by a distance approximately equivalent to the length of an elongated tube light 122. This interconnecting apparatus comprises a transition section 130 adjacent one end of each of two channel light trays and a means, fixedly attached to each transition section 130, for detachably mounting and energizing elongated tube lights 122. The transition section 130 is dimensioned to be complementarily mated with and fixedly attached to the adjacent ends of the two channel light trays, thereby interconnecting the two channel light trays to form a resultant channel 115. Alternatively, the transition section 130 can be disposed in and attached to a continuous channel 115. One end of each light 122 is detachably mounted to the transition section 130 in an overlapping relationship with one end of another light 122 being detachably mounted to the same transition section 130. As a result, the light emitted from a plurality of interconnected, longitudinally extending apparatus 110 appears continuous without breaks or areas of dimming.

As discussed above, the mounting and energizing means can be lamp receptacles 120. Each transition section 130 preferably has a pair of lamp receptacles 120 facing along the channel light trays in opposite directions and disposed at opposite corners and on opposite sides of the transition section 130. Alternatively, more lamp receptacles can be used in one transition section 130.

Also as discussed above, the elongated tube lights 122 can be arranged in an overlapping herringbone configuration as shown in FIG. 4 or can be arranged in an overlapping parallel configuration as shown in FIGS. 6A and 6B. The transition section 130 can also comprise multiple transition section parts 134, 136, as shown in FIG. 5.

Although the present process has been described with reference to specific details of certain embodiments thereof, it is not intended that such details should be regarded as limitations upon the scope of the invention except as and to the extent that they are included in the accompanying claims.

What is claimed is:

1. An apparatus for providing lighting utilizing a plurality of elongated tube lights each having opposing ends, comprising:

(a) a channel having a front end and an opposite rear end;

(b) at least one transition section disposed in the channel;

(c) two end sections, a first end section disposed in the front end of the channel and a second end section disposed in the rear end of the channel; and (d) means, fixedly attached to the transition section and the two end sections, for detachably mounting and energizing the elongated tube lights, wherein one end of each light is detachably mounted to the transition section in an overlapping relationship with one end of another light detachably mounted to the transition section and the opposed end of each light is detachably mounted to selected one of another transition section or one of the two end sections, wherein the transition section comprises at least two parts that can be placed at a plurality of different separation distances in which separation distance between the first end section and the second end section is varied for each different separation distance between the parts.

2. The apparatus of claim 1, further comprising means for fixedly securing the channel to a stationary member.

3. The apparatus of claim 1, further comprising a cover plate that is complementary to and designed to be disposed above the channel, whereby a closed volume is formed defined by the channel and the cover plate.

4. The apparatus of claim 1, wherein the mounting and energizing means are lamp receptacles.

5. The apparatus of claim 4, wherein each transition section has a pair of lamp receptacles facing along the channel in opposite directions disposed at opposite corners and on opposite sides of the transition section.

6. The apparatus of claim 5, wherein each end section has one lamp receptacle which is directed along the channel such that a selected one of the lamp receptacles on the transition section is directed toward a corresponding lamp receptacle mounted to one end section, wherein one light is affixed therebetween.

7. The apparatus of claim 1, wherein the elongated tube lights are arranged in an overlapping herringbone configuration.

8. The apparatus of claim 1, wherein the elongated tube lights are arranged in an overlapping parallel configuration.

9. An apparatus for providing lighting utilizing a plurality of elongated tube lights each having opposing ends, comprising;

(a) a channel having a front end and an opposite rear end separated therebetween by a length;

(b) at least one transition section disposed in the channel;

(c) two end sections, a first end section disposed in the front end of the channel and a second end section dispose in the rear end of the channel; and (d) means, fixedly attached to the transition section and the two end sections, for detachably mounting and energizing the elongated tube lights, wherein one end of each light is detachably mounted to the transition section in an overlapping relationship with one end of another light detachably mounted to the transition section and the opposed end of each light is detachably mounted to selected one of another transition section or one of the two end sections, wherein the channel is a "U" shaped channel having a bottom having two opposed longitudinal edges and two parallel side panels fixedly attached to the edges of the bottom and upwardly extending therefrom, wherein the "U" shaped channel comprises a plurality of "U" shaped sections each having a length, wherein one transition section is telescopically received by either end of two adjacent "U" shaped sections and fixedly attaches the two "U" shaped sections adjacent to each other.

10. The apparatus of claim 9, wherein the length of each "U" shaped section is approximately equivalent to the length of one elongated tube light.

11. An apparatus for interconnecting at least two channel light trays, each channel light tray having two opposing ends being separated therebetween by a distance approximately equivalent to a length of an elongated tube, light, comprising:

(a) a transition section adjacent one end of each of two channel light trays, the transition section being dimensioned to be complementarily mated with and fixedly attached to the adjacent ends of the two channel light trays, thereby interconnecting the two channel light trays to form a resultant channel; and (b) means, fixedly attached to the transition section, for detachably mounting and energizing elongated tube lights, wherein one end of each light detachably mounted to the transition section is in an overlapping relationship with one end of another light detachably mounted to the transition section.

12. The apparatus of claim 11, further comprising means for fixedly securing the resultant channel to a stationary member.

13. The apparatus of claim 11, further comprising a cover plate that is complementary to and designed to be disposed above each channel light tray, whereby a closed volume is formed defined by the channel light tray and the cover plate.

14. The apparatus of claim 11, wherein the mounting and energizing means are lamp receptacles.

15. The apparatus of claim 14, wherein the transition section has a pair of lamp receptacles facing along the channel light trays in opposite directions disposed at opposite corners and on opposite sides of the transition section.

16. The apparatus of claim 11, wherein the elongated tube lights are arranged in an overlapping herringbone configuration.

17. The apparatus of claim 11, wherein the elongated tube lights are arranged in an overlapping parallel configuration.

18. The apparatus of claim 11, wherein the transition section comprises at least two parts that can be placed at a plurality of different separation distances.

19. An apparatus for providing lighting utilizing a plurality of elongated tube lights each having opposing ends, comprising:

(a) a channel having a front end and an opposite rear end;

(b) at least one transition section disposed in the channel;

(c) two end sections, a first end section disposed in the front end of the channel and a second end section disposed in the rear end of the channel; and (d) means, fixedly attached to the transition section and the two end sections, for detachably mounting and energizing the elongated tube lights, wherein one end of each light is detachably mounted to the transition section in an overlapping relationship with one end of another light detachably mounted to the transition section and the opposed end of each light is detachably mounted to selected one of another transition section or one end section, wherein the overlapping relationship between the ends of two lights connected to the detachably mounting means of one of the transition sections is varied so that separation distance between the first end section and the second end section is altered.

* * * * *